US005517914A

United States Patent [19]

Tilton, Sr.

[11] Patent Number: 5,517,914

[45] Date of Patent: May 21, 1996

[54] WEB TENSION REGULATOR FOR PRINTING MACHINE

[76] Inventor: Danny E. Tilton, Sr., 31 Glenwood St., Dayton, Ohio 45405

[21] Appl. No.: 316,522

[22] Filed: Sep. 30, 1994

[51] Int. Cl.[6] ..... B41F 13/56

[52] U.S. Cl. ..... 101/226; 226/3; 226/44

[58] Field of Search ..... 101/226, 228, 101/248; 400/621, 613; 242/75.43, 75.1, 75.51, 75.53, 75.43, 75.44, 353; 226/3, 44

[56] References Cited

U.S. PATENT DOCUMENTS

| | | | |
|---|---|---|---|
| 3,556,510 | 1/1971 | Treff | 226/25 |
| 3,659,767 | 5/1972 | Martin | 226/25 |
| 3,822,838 | 7/1974 | Butler, Jr. et al. | 242/75.43 |
| 3,912,145 | 10/1975 | Meihofer | 226/44 |
| 4,015,994 | 4/1977 | Meihofer | 242/75.44 |
| 4,147,104 | 4/1979 | Zernov et al. | 101/228 |
| 4,214,943 | 7/1980 | Stern | 242/75.4 |
| 4,359,178 | 11/1982 | Hayashi et al. | 101/225 |
| 4,470,348 | 9/1984 | Seeley et al. | 101/219 |
| 4,541,340 | 9/1985 | Peart et al. | 101/470 |
| 4,569,584 | 2/1986 | St. John et al. | 101/151 |
| 4,743,319 | 5/1988 | Ramoke | 156/64 |
| 4,852,484 | 8/1989 | Karakawa et al. | 101/170 |
| 4,888,717 | 12/1989 | Ditto et al. | 226/3 |
| 5,156,350 | 10/1992 | Wales et al. | 242/75.1 |
| 5,263,854 | 11/1993 | Bradshaw | 242/75.43 |
| 5,365,844 | 11/1994 | Miyashige | 101/228 |
| 5,386,772 | 2/1995 | Tolle et al. | 101/248 |
| 5,390,599 | 2/1995 | Matsumoto et al. | 101/226 |
| 5,397,044 | 3/1995 | Suzuki | 101/228 |
| 5,400,940 | 3/1995 | Sato et al. | 101/228 |
| 5,402,957 | 4/1995 | Evans | 242/353 |

*Primary Examiner*—Eugene H. Eickholt
*Attorney, Agent, or Firm*—Jacox, Meckstroth & Jenkins

[57] ABSTRACT

An apparatus for use with a printing press including a tension regulator for maintaining a substantially constant tension level on a web of printing medium passing through the printing press. The printing press has at least one dancer roller, and the tension regulator includes an actuator associated with the dancer roller for maintaining a constant biasing force on the dancer roller. The tension regulator also includes a reservoir which communicates with a first chamber of the actuator to define a second chamber larger than the first chamber. The volume of the second chamber is large enough that changes thereto are negligible to the extent that a piston of the actuator is displaced. Therefore, the pressure within the second chamber remains constant which permits a constant biasing force to be applied to the piston regardless of the displacement of the piston. With a constant biasing force applied to the dancer roller, the web tension is maintained constant regardless of instantaneous changes in feed and take-up rates of the web of printing material.

19 Claims, 6 Drawing Sheets

WEB TENSION REGULATOR FOR PRINTING MACHINE

FIELD OF THE INVENTION

This invention relates to a web tension regulator for a printing press, and more particularly to a web tension regulator which maintains a substantially constant tension on a web of printing medium passing through the printing press.

BACKGROUND OF THE INVENTION

In the field of printing presses, such as flexographic printing presses, it is important to maintain a constant tension of a web of printing medium or material passing through a press to control the quality of an image printed on the web of medium. This is particularly true in flexographic printing presses that have multiple printing stations for applying different colors because if an image printed on the web at one printing station does not register or align with a subsequent image printed at another printing station, then the resulting composite printed image will appear blurred and possibly discolored.

It is critical to maintain a constant tension of the a web of printing medium when the printing medium is a non-elastic extensible material such as foil. Foil material exhibits non-elastic properties so that once it is stretched, for instance under varying tension levels as it passes through the printing press, the foil remains stretched which results in the registry problem mentioned above.

It is known to use a horizontal or vertical dancer roller assembly to maintain the tension of the web of printing medium passing through the printing press. A conventional dancer roller assembly includes a plurality of dancer rollers, any number of which are fixedly mounted to a frame of the printing press while the remaining rollers are slidable toward and away from the fixed rollers. The web of printing medium is fed from a mill or supply roll through the dancer rollers before being fed to the successive printing stations and taken up at a take-up station.

The position of the slidable dancer rollers relative to the fixed dancer rollers is a function of the amount of web material being fed to the printing stations in relation to the amount of web material being pulled through the printing stations by a take-up roller at a given time. When more printing material is being fed to the printing stations than can be printed by the printing stations, the dancer roller assembly takes up the excess printing material by urging the slidable dancer rollers away from the fixed dancer rollers to extend the length of travel of the web of material upstream from the printing stations. When not enough printing material is being fed to the printing stations in relation to the amount of web material passing through the printing stations, the dancer roller assembly feeds additional printing material to the printing stations by urging the slidable dancer rollers toward the fixed dancer rollers to reduce the length of travel of the web of printing material upstream from the printing stations.

In order to accurately maintain the tension of the web of printing medium as it passes through the printing press, it is necessary to maintain a constant bias on the dancer roller assembly, and more particularly on the slidable dancer rollers so that no bias fluctuations will be transmitted to the web of printing medium to cause the undesirable web tension variations. Springs have previously been used in an attempt to maintain the required constant bias on the dancer roller assembly. However, a spring generally does not provide a constant force throughout a full range of compression and extension of the spring. Thus, springs can not maintain a constant bias on a dancer roller assembly to the level required for printing on a web of non-elastic extensible printing medium.

What is needed therefore is an apparatus for maintaining a constant biasing force on a dancer roller assembly so as to maintain a substantially constant tension on a web of printing medium.

SUMMARY OF THE INVENTION

Thus, it is a primary object of this invention to provide an apparatus and method for maintaining a substantially constant tension on a web of printing medium passing through a printing press to improve the quality of a resulting composite printed image.

In one aspect of the invention, an apparatus for use with a printing press is provided which includes a tension regulator for maintaining a substantially constant tension level on a web of printing medium passing through the printing press.

In another aspect, a printing press is provided which includes a plurality of successive printing stations, a print material feeding station positioned upstream of the printing stations for supplying a web of the printing material to the printing stations, a printing material take-up station positioned downstream of the printing stations for pulling the web of print material through the printing stations and storing the printed material, and a tension regulator for maintaining a substantially constant tension level on a web of printing medium passing through the printing press.

In still another aspect of the invention, a method is provided for maintaining a constant tension on a web of printing material being fed through a printing press to maintain a high degree of printing registry at each of a plurality of printing stations of the printing press wherein the method includes passing the web of printing material through the printing press along a longitudinal axis of the printing press, adjusting a path of travel of the web through at least one slidable dancer roller to compensate for web tension fluctuations as the web is passed through the printing press, and maintaining a constant force on the at least one slidable dancer roller as the path of travel of the web is adjusted.

These and other objects and advantages of the invention will be apparent from the following description, the accompanying drawings and the appended claims.

DETAILED DESCRIPTION OF THE PREFERRED EMBODIMENTS

Figure 1:
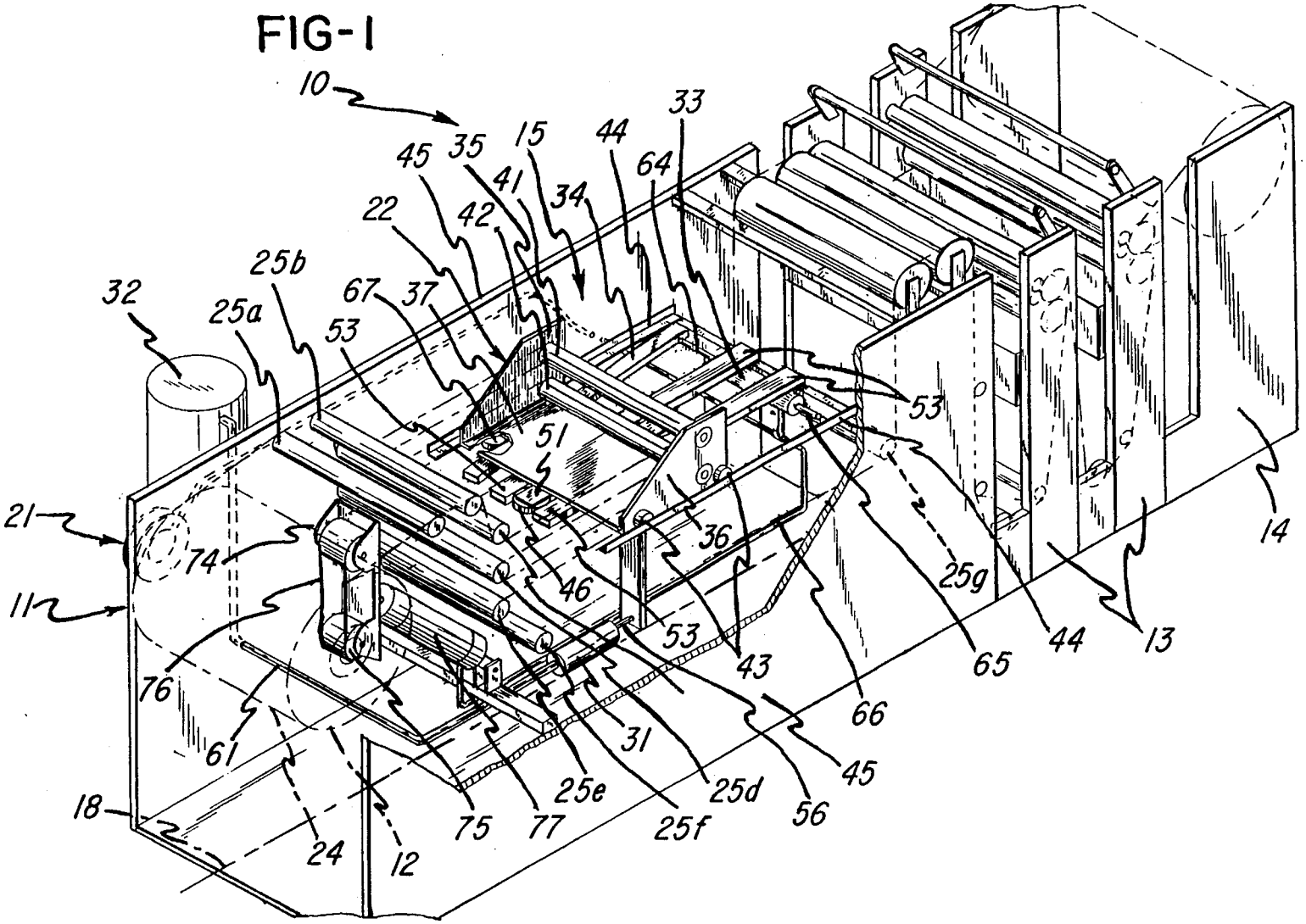
FIG. 1 is a perspective view of a multistation printing press which incorporates the tension regulator of the present invention.

Referring now to FIG. 1, there is shown a flexographic printing system or press 10 which incorporates a web tension regulator apparatus 15 of the present invention. It should be appreciated that although the invention is shown and described in relation to a flexographic printing environment, it could be used in any environment where web tension is critical. The press 10 includes a feeding station 11 for supplying a web 12 to a plurality of printing stations 13 positioned downstream from the feeding station along a longitudinal axis 18 of the printing press 10. The web 12 can be any material such as paper, plastic, foil etc. which is suitable for printing. A take-up station 14 is positioned downstream from the printing stations and takes up the web of printing medium 12 after it has passed through the printing stations. Although the stations 13 are shown as printing stations, one or more of the printing stations could perform an operation other than printing. For example, one of the stations 13 could be a perforating station for perforating predetermined areas (not shown) on the web 12.

Figure 2:
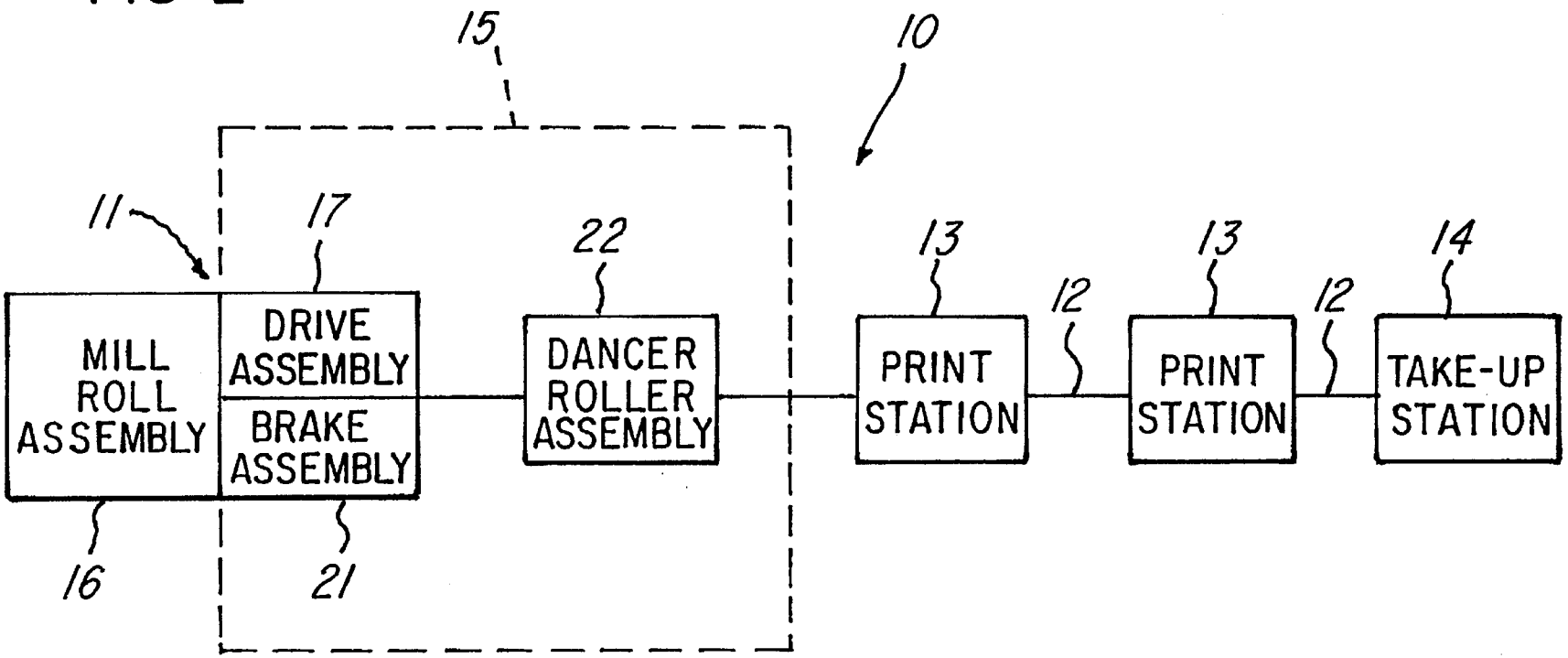
FIG. 2 is a block diagram of the printing press shown in FIG. 1.

Referring now to FIG. 2, there is shown a block diagram of the printing press 10 which incorporates the tension regulator apparatus 15 of the present invention. The tension regulator apparatus 15 includes a mill roll drive assembly 17 and a mill roll brake assembly 21 associated with a mill roll assembly 16 of the feeding station 11, and a dancer roller assembly 22 positioned intermediate the feeding station 11 and the printing stations 13. The mill roll assembly 16 provides the web of printing medium 12 to the printing stations 13.

Figure 3:
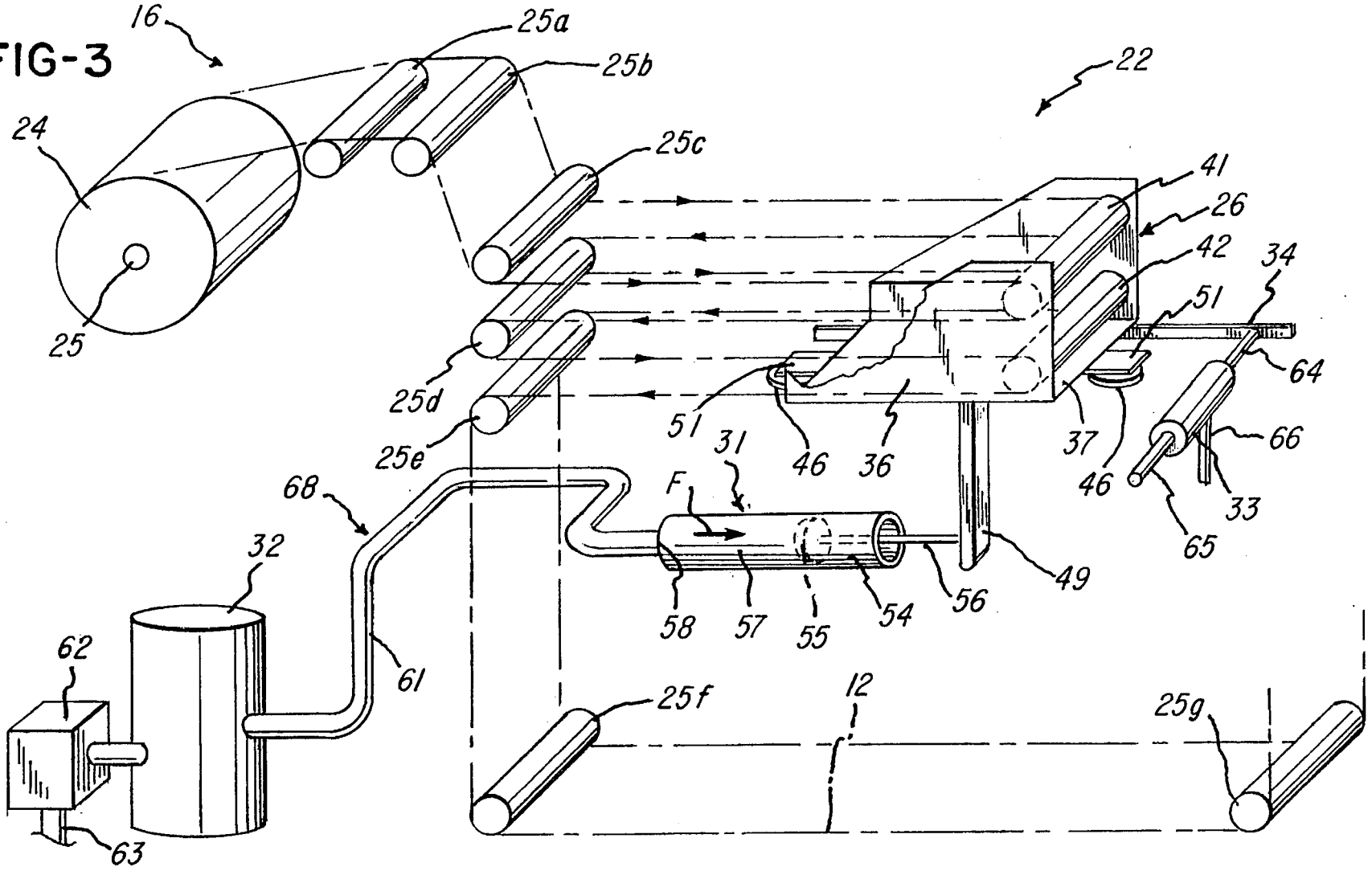
FIG. 3 is a perspective view of a web of printing medium being fed from a mill roll assembly through a dancer roller assembly of the tension regulator apparatus.

As best shown in FIG. 3, the mill roll assembly 16 of the feeding station 11 includes a mill roller 23 extending axially through, and rotatably supporting a mill roll 24 of printing medium, and a plurality of idler rollers 25*a*–25*g* which guide the web 12 from the mill roll 24 through the dancer roller assembly 22 to the printing stations 13. The mill roller 23 and the idler rollers 25*a*–25*g* extend perpendicularly to the longitudinal axis 18 of the printing press.

Figure 4:
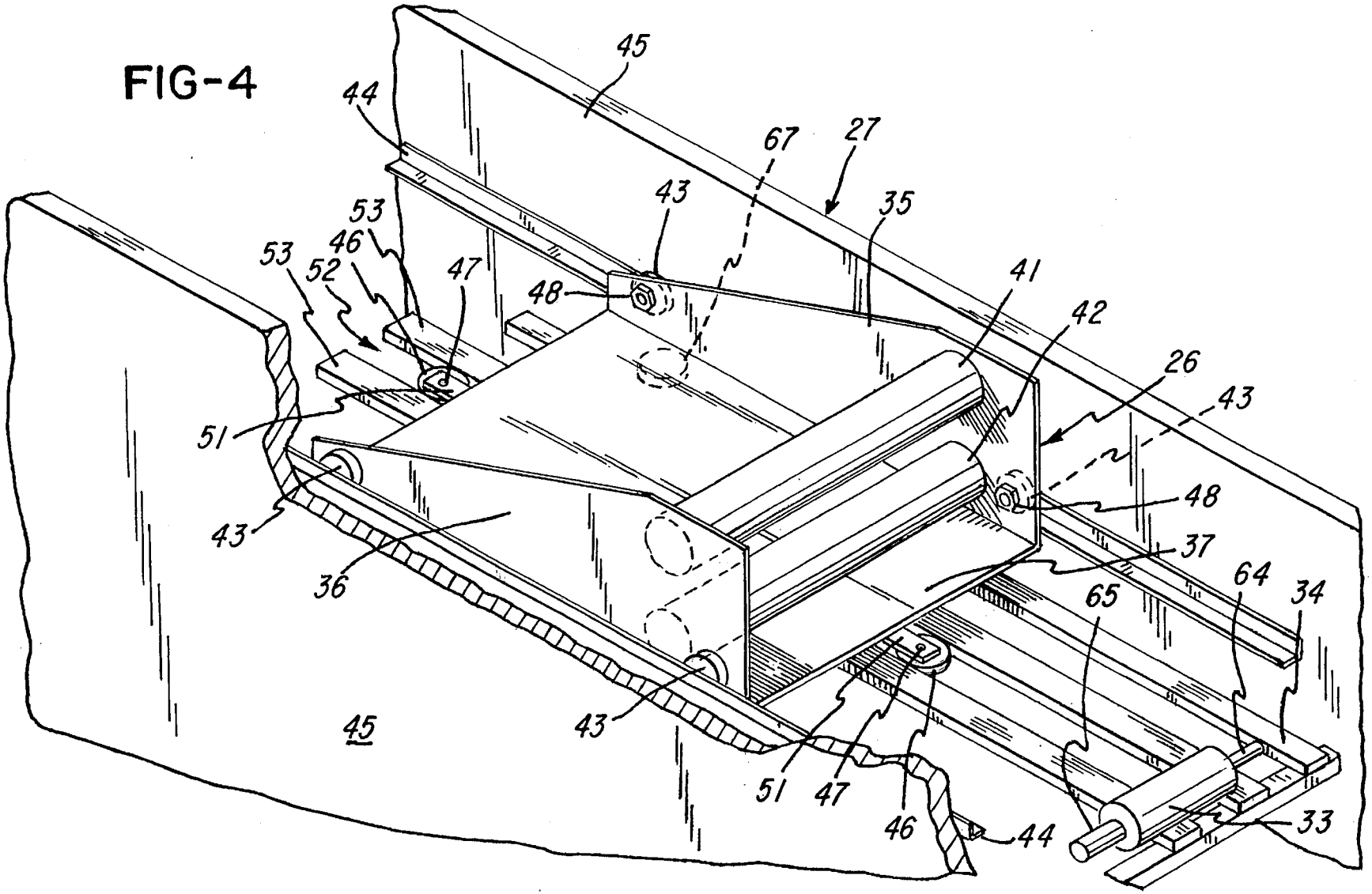
FIG. 4 is a perspective view of a slidable dancer roller carriage of the dancer roller assembly in cooperation with a fixed carriage frame of the printing machine.
Figure 5:
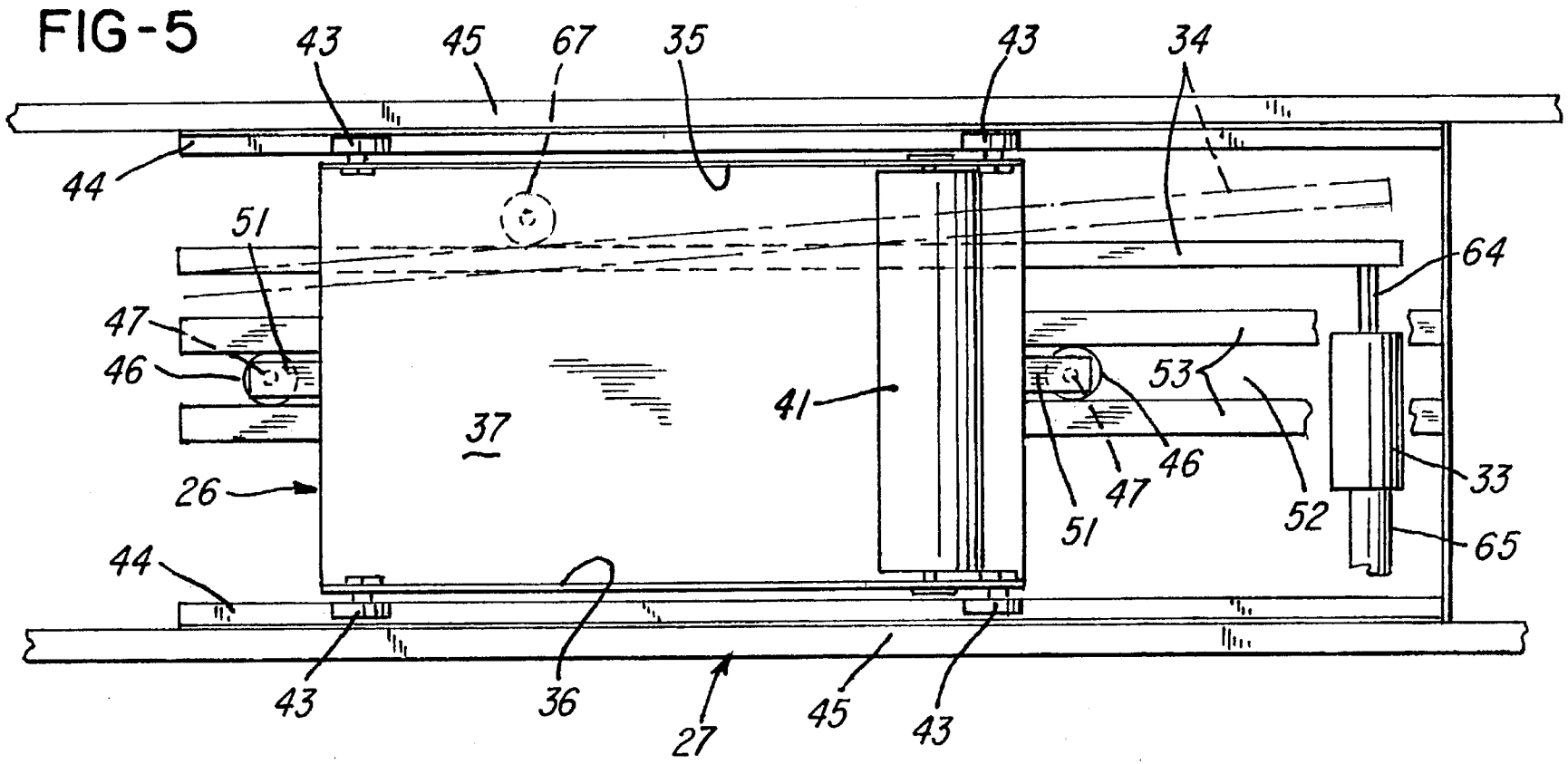
FIG. 5 is a top plan view of the slidable dancer roller carriage and frame shown in FIG. 4.

As best seen in FIGS. 3, 4 and 5, the dancer roller assembly 22 includes a dancer roller carriage 26 which is slidably retained within a dancer roller frame assembly 27 (FIG. 4) of the press 10, a pneumatic biasing actuator 31 (FIG. 3) coupled to the carriage 26, a pressurized accumulator or reservoir 32 in fluid communication with the actuator 31, a linear air pressure regulator 33, and a cantilevered control arm 34 which progressively actuates and de-actuates the pressure regulator 33 as a function of the position of the dancer roller carriage 26 along the longitudinal axis within the frame 27.

The dancer roller carriage 26 is U-shaped in cross-section and is slidable toward and away from the mill roll 24 along the longitudinal axis. The carriage 26 includes two upstanding spaced-apart side walls 35 and 36, a base portion 37 connected to respective lower edges of the side walls 35, 36, and upper and lower vertically spaced-apart dancer rollers 41 and 42 each having a central shaft portion which is rotatably supported by, and extends between the side walls 35, 36 perpendicular to the longitudinal axis 18.

The dancer roller carriage 26 also includes a plurality of guide wheels which cooperate with corresponding guide tracks of the frame 27 to provide for free movement of the carriage 26 along the longitudinal axis. Four vertically oriented guide wheels 43 are rotatably supported by horizontally extending shafts or axles 48 which extend outwardly from the respective side walls 35, 36 in directions perpendicular to the longitudinal axis 18. The guide wheels 43 cooperate with, and are retained by complementary angle iron tracks 44 extending longitudinally along each side wall portion 45 of the frame 27. Two horizontally oriented guide wheels 46 are rotatably supported by vertically extending shafts or axles 47 which project downwardly from respective flanges 51 that extend centrally from the base portion 37 along the longitudinal axis. The guide wheels 46 cooperate with, and are retained by a complementary central base wall track 52 which is defined by two spaced-apart longitudinally extending struts 53 of the frame 27. The rollers 43, 46 and the guide tracks 44, 52 provide for substantially frictionless movement of the carriage 26 along the longitudinal axis within the frame 27.

As shown in FIG. 3, the pneumatic actuator 31 includes a hollow cylindrical actuator body 54 attached to the frame (not shown) of the printing press 10, a piston 55 is slidably retained within the actuator body 54, and an actuator arm or plunger 56 is connected to a first side of the piston 55. An opposite end of the actuator arm 56 is connected to a connector bar 49 extending vertically downwardly from the base portion 37 of the carriage 26 such that the piston 55 is adapted to act on the carriage 26 to apply a constant tension force on the web 12, as described further below.

The actuator body 54 has a bore or inner diameter of approximately four inches, and the piston has a stroke of approximately 24 inches within the body 54. The actuator body and the piston cooperate to define a first inner chamber or cavity 57 remote from the actuator arm 56 which has a volume which is a function of a linear position of the piston within the actuator body 54. The cylinder body 54 includes a port 58 extending through an end wall of the body 54, which port is approximately two inches in diameter.

In addition, a conduit 61 extends between the pressurized reservoir 32 and the port 58 and has a diameter of approximately two inches to thereby provide substantially unrestricted fluid communication between the chamber 57 and the reservoir 32. The reservoir 32 is preferably a sealed tank having a capacity of approximately 80 gallons. The reservoir 32 includes a pressure regulator/pressure gauge 62 which selectively pressurizes the reservoir to about 1.0 to 2.0 pounds per square inch, and preferably to about 1.5 pounds per square inch. The pressure regulator has an inlet/outlet opening 63 for supplying air to the reservoir when necessary. It is to be understood that the reservoir 32 could be any type of device which could maintain a pressurized medium. For instance, the sealed tank could be replaced by an extended length of PVC pipe or the like forming a reservoir for effectively increasing the volume of the actuator cylinder. Further, the reservoir could be an expandable rubber bladder or balloon which maintains a substantially constant pressure level by increasing the volume thereof to compensate for an increase in air pressure within the balloon.

The dancer roller assembly 22 provides a variable path length of travel for the web 12 in order to maintain a predetermined tension on the web 12 under varying conditions, which web tension is a function of a constant biasing or damping force F applied to the dancer roller carriage 26 by the pneumatic biasing actuator 31. The dancer roller carriage 26 has a range of travel of approximately 24 inches within the frame 27. The variable path length through the dancer roller assembly 22 is defined as the sum of distances between rollers 25*c* and 41, 41 and 25*d*, 25*d* and 42, and 42 and 25*e*. Thus, the fixed rollers 25*c*, 25*d* and 25*e*, and dancer rollers 41, 42 of the slidable carriage 26 cooperate to provide a maximum path length of approximately 96 inches when the dancer roller carriage is at a fully downstream position. For instance, when an excess supply of web 12 is provided by the feed station, thus reducing the web tension, the biasing force F applied to the dancer roller carriage 26 by the biasing actuator 31 urges the dancer roller carriage 26 downstream to increase the path length thereby accommodating the excess web 12 supplied by the feed station. When a shortage of web 12 is provided by the feed station, thus increasing the web tension, the dancer roller carriage 26 is urged upstream against the biasing force F to decrease the path length thereby providing more web to the print stations.

The position of the carriage 26 along the longitudinal axis is directly related to the feed and take-up rates of the feed and take-up stations 11 and 14, respectively. For example, if the feed station 11 feeds the web 12 at a slower speed than the web 12 is being pulled by the take-up station 14, then the tension on the web 12 would increase without the dancer roller assembly 22 present. However, in response to the feed rate being less than the take-up rate, the dancer roller carriage 26 is urged upstream toward the feed station 11 to maintain the supply of the web to the printing stations at the speed dictated by the take-up station 14 whereby a constant tension is maintained on the web 12 passing through the printing stations.

The actuator 31 and the reservoir 32 counter the upstream movement of the carriage 26 by applying a constant biasing force to the piston 54 to thereby control the upstream movement of the carriage 26. More specifically, the actuator 31 and reservoir 32 cooperate to maintain a constant level of the biasing force F applied to the piston 55 and the dancer roller carriage 26 via the actuator arm 56 and connecting rod 49 regardless of the position of the dancer roller carriage along the longitudinal axis. The biasing or damping force F acts in a downstream direction to counter an upstream force applied to the carriage 26 which is generated by the web 12 being fed from the mill roll assembly 16 while being simultaneously pulled by the take-up station 14.

If the feed station 11 feeds the web 12 at a faster speed than the web 12 is being pulled by the take-up station 14, then the tension on the web 12 would decrease if the dancer roller assembly 22 was not present. However, in response to the feed rate being greater than the take-up rate, the actuator 31 urges the dancer roller carriage 26 downstream toward the printing stations 13 to take up the excess supply of the web 12 being fed to the printing stations 13 and maintain the web supply to the print stations at the speed dictated by the take-up station 14, thus maintaining a constant tension on the web 12 passing through the printing stations 13. Thus, the dancer roller 26 carriage will be urged downstream as a result of the upstream force applied by the web 12 to the carriage 26 being less than the downstream biasing force F applied by the actuator 31.

In order to maintain a substantially constant tension on the web 12 as the feed and take-up rates instantaneously fluctuate, it is critical that the biasing force F applied to the piston 55 and the carriage 26 remain constant regardless of the direction and extent of motion of the piston 55 and carriage 26. The force applied to the piston 55 and carriage 26 can be determined from the following formula:

$$F=P\times A \tag{1}$$

where F is the biasing force applied to the piston in pounds; P is the pressure applied to the piston in pounds per square inch; and A is the area of the piston in square inches. In the present invention, the area A of the four inch diameter piston 55 is 12.57 square inches, and the pressure P applied to the piston 55 is about 1.5 pounds per square inch, thus the force F applied to the piston 55 and carriage 26 is approximately 19.0 pounds of pressure.

It can been seen from formula (1) that to maintain a constant biasing force F applied to a fixed piston area A, it is necessary to maintain a constant pressure P applied to the surface of the piston. The pressure P in a given volume V can be determined from the following formula:

$$P=\frac{53.3\,(T)}{V} \tag{2}$$

wherein P is the absolute pressure in pounds per square foot; T is the absolute temperature in degrees Rankine; and V is the volume in cubic feet of one pound of air at the given pressure and temperature.

In a typical prior art pneumatic actuator, the chamber of the actuator is connected to a pressure regulator valve via an orifice in the actuator body. The pressure regulator acts to dump air pressure within the chamber that exceeds a predetermined pressure level. When the piston within the actuator body is displaced by the carriage, the piston changes the volume of the chamber which inversely affects the pressure P within the chamber as seen from Formula (2). Even if the pressure regulator is set to a low pressure threshold, the orifice and the pressure regulator cannot instantaneously discharge the excess air pressure from the chamber when the piston is driven to reduce the volume of the chamber. Therefore, the air pressure P within the chamber will disadvantageously spike above the predetermined pressure level which causes the biasing force F applied to the piston to likewise spike in accordance with formula (1). For instance, per formula (2), when the piston is driven upstream, the volume of the chamber is reduced resulting in an instantaneous pressure increase within the chamber greater than the predetermined pressure level set by the pressure regulator valve because the instantaneous pressure increase can not be discharged through the orifice and/or the pressure regulator quick enough to maintain a constant pressure level P within the chamber. In accordance with formula (1), the corresponding increase in pressure P within the chamber causes an increase in the biasing force F applied to the piston which is then transmitted to the carriage and results in a fluctuation or spike of the web tension.

In the present invention, the biasing force F applied to the surface of the piston 55 is held constant by maintaining a substantially constant pressure P within the chamber 57 regardless of the displacement of the piston 55 within the actuator body 54. The pressure P within the chamber 57 is maintained by substantially increasing the static volume V of the chamber 57 so that the change in volume of the chamber that results from the piston displacement is a small percentage of the overall static volume and has a negligible effect on the pressure P within the chamber. In a preferred embodiment, the increased static volume of the chamber 57 permits the pressure P within the chamber to remain within 1.0% of the preferred pressure of 1.5 pounds per square inch regardless of the piston 55 displacement.

In accordance with formula (2), assuming that temperature T is constant, if the change in the volume of the chamber can be made negligible relative to static volume V of the chamber, then the resulting change in pressure P within the chamber will also be negligible and can be considered constant. Thus, in the present invention, the chamber 57 and the reservoir 32 communicate via conduit 61 and port 58 to define a second chamber 68 which has a volume much greater than the chamber 57 alone. The volume of the second chamber 68 is so great that changes thereto are negligible to the extent that the piston 55 is displaced. Stated otherwise, for all practical purposes, the volume of the second chamber 68 remains substantially constant regardless of piston displacement. Therefore, the pressure P within the chamber 68 remains constant per formula (2) which results in a constant biasing force F per formula (1) to be applied to the piston 55 regardless of the displacement of the piston. With a constant biasing force F applied to the piston, no biasing force fluctuations are transmitted to the carriage 26 and the web tension is maintained constant regardless of instantaneous changes in the feed and take-up rates of the web 12. Further, the conventional orifice associated with prior art actuators is replaced with the port 58 which permits a substantially unrestricted flow of pressurized air therethrough to eliminate the likelihood of air pressure building up within chamber 57 when the piston is driven upstream to reduce the volume of chamber 57. In addition, since the pressure P within the chamber 68 is maintained substantially constant, no excess air pressure is discharged from the pressure regulator 62 when the piston 55 is displaced as with conventional pneumatic biasing actuators.

The dancer roller carriage 26 compensates for small differences between the feed and take-up rates of the web 12. However, large cumulative differences between the feed and take-up rates, resulting in continued movement of the carriage toward an upstream or downstream end of the dancer roller frame assembly 27, requires an additional level of feedback control. For this purpose, the present invention includes the mill roller drive assembly 17 and mill roller brake assembly 21 which cooperate to control the feed rate of the web 12 as a function of the linear position of the dancer roller carriage 26 within the frame 27.

As best seen in FIGS. 3–6, the linear air pressure regulator 33 is mounted to the frame 27 downstream from the carriage 26 and includes a mechanically actuatable plunger 64, an inlet line 65 for supplying pressurized air to the pressure regulator 33, and an air pressure outlet line 66 which supplies the pressurized air from inlet line 65 to the drive assembly 17 via outlet line portion 66*a*, and to the brake assembly 21 via outlet line portion 66*b*. The pressurized air in the inlet line 65 is regulated to about 60 psi. The pressurized air at the outlet line 66, and hence in outlet line portions 66*a* and 66*b*, is varied as a function of the position of the plunger 64 in a range of about 0 to 60 psi. The air pressure at the outlet line 66 increases as the plunger 64 is depressed, and decreases as the plunger 64 is released to extend from the regulator 33.

The cantilevered control arm 34 is pivotally mounted to the frame 27 below the carriage 26 so that a free end of the control arm 34 can engage the plunger 64. The free end of the control arm 34 is urged toward and away from the plunger 64 by means of a horizontally oriented guide wheel or bearing 67 mounted to and extending below the base portion 37 of the carriage 26. The control arm 34 is positioned so as to extend transversely to an axis of travel of the guide wheel 67, which axis is parallel with the longitudinal axis 18. The free end of the control arm 34 is pivotally urged into and out of engagement with the plunger 64 as a function of carriage 26 position along the longitudinal axis 18.

In operation, when the carriage 26 is in a maximum upstream position, the free end of the control arm is urged away from the plunger 64 by the spring action of the cantilevered control arm. As the carriage 26 is displaced in a downstream direction, the guide wheel 67 urges the control arm toward and into engagement with the plunger 64. Thus, the linear position of the dancer roller carriage 26 determines the magnitude of the air pressure supplied to the outlet line 66.

Figure 6:
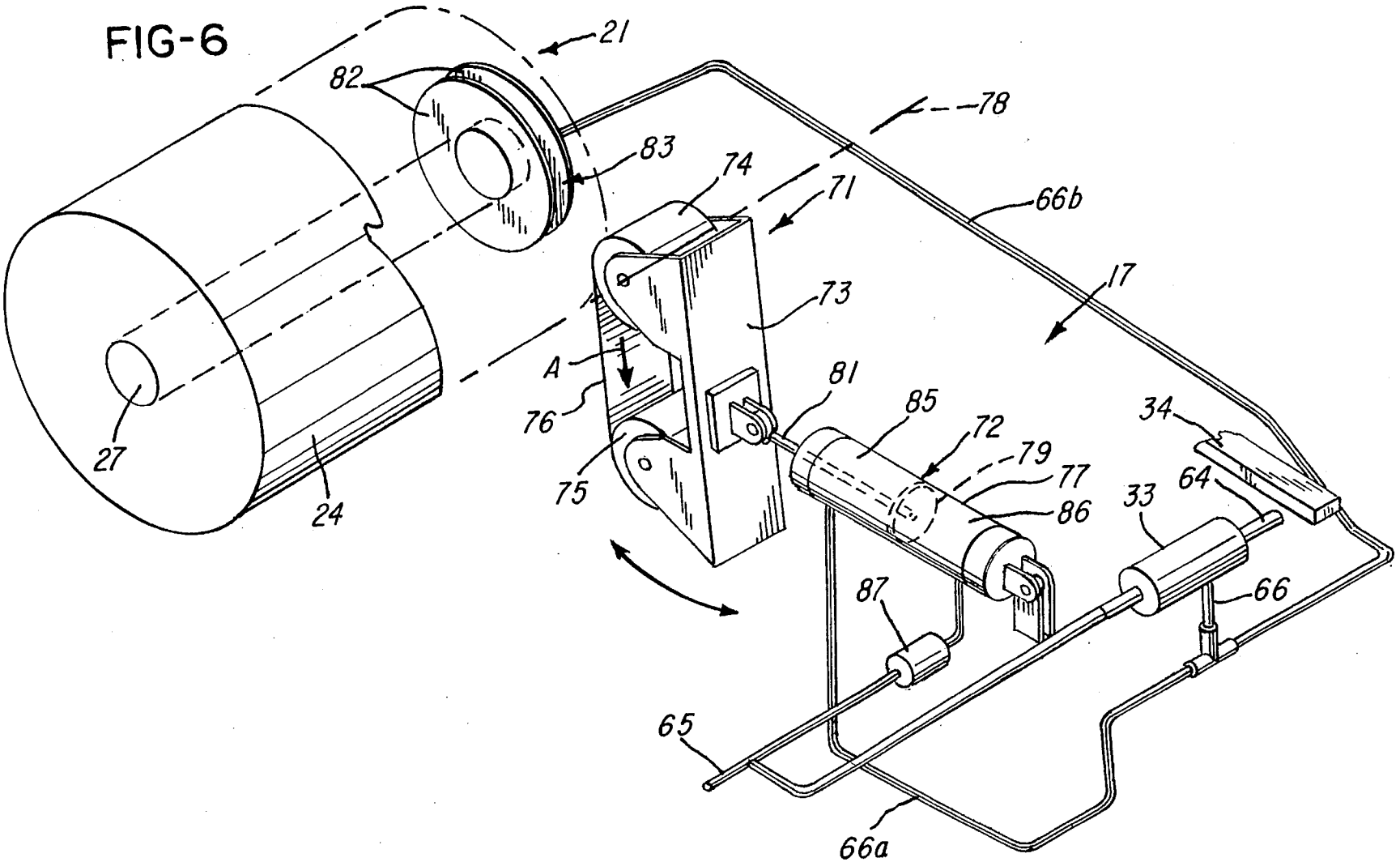
FIG. 6 is a perspective view of a mill roll drive assembly and a mill roll brake assembly of the tension regulator apparatus.

As best seen in FIG. 6, the air pressure supplied by the outlet line 66 is simultaneously fed to the mill roller drive assembly 17 via outlet line 66*a*, and the mill roller brake assembly 21 via outlet line 66*b*. The mill roller drive assembly 21 includes a drive belt assembly 71 and a pneumatic drive actuator 72. The drive belt assembly 71 includes a frame member 73 which rotatably supports first and second spaced-apart rollers 74 and 75 which rotatably drive a drive or unwind belt 76 in a counter-clockwise direction as shown by the arrow A. The frame member 73 is oriented so as to pivot toward and away from the mill roll 24 about a pivot axis 78 passing through the rotational axis of the first roller 74 whereby the belt 76 is moved into and out of contact with the mill roll 24 to drive the mill roll 24 in rotation. The drive belt 76 is preferably a timing belt having an outer surface comprising a non-marking material so as to prevent marring the web 12 as it is being driven by the drive assembly 17. At least one of the rollers 74 and 75 is conventionally driven at a constant rate by a conventional gear or belt assembly not shown.

The drive actuator 72 includes a hollow actuator body 77 fixedly connected to the frame of the printing press 10, and an actuator arm 81 having a first end coupled to the frame member 73 and a second end coupled to a piston 79 slidably disposed within the actuator body 77. The actuator body 77 and the piston 79 cooperate to define two variable volume chambers 85, 86. The first chamber 85 communicates with the outlet line portion 66*a*, and the second chamber 86 communicates with the inlet line 65 via an in-line step-down air regulator 87. The step-down regulator 87 drops the pressurized air down from about 60 psi to about 23 psi before feeding the pressurized air to the second chamber 86.

When the feed rate of the web 12 is greater than the take-up rate, the carriage 26 is urged in a downstream direction. In response to the downstream movement of the carriage 26, the control arm 34 is progressively urged into engagement with the plunger 64 to release progressively greater amounts of pressurized air into the outlet line 66. The pressurized air in outlet line 66*a* is discharged into the first chamber 85 to displace the piston 79 and the actuator arm 81 against the biasing force of the pressurized air in the second chamber 86 supplied from line 65. The drive belt assembly 71 is urged pivotally away from the mill roll 24 thus gradually disengaging the drive belt assembly 71 from the mill roll 24 to permit the mill roll 24 to rotate at a slower feed rate. When the carriage 26 is urged in a fully downstream position, the drive belt assembly 71 is fully disengaged from the mill roll 24.

Conversely, when the feed rate of the web 12 is less than the take-up rate, the carriage 26 is urged in an upstream direction which permits the control arm 34 to progressively disengage from the plunger 64 and reduce the amount of pressurized air in the outlet line 66. The reduced pressurized air in line 66*a* results in the drive belt assembly 71 being urged toward and into greater engagement with the mill roll 24 thus permitting the mill roll 24 to be driven at a greater feed rate. When the carriage 26 is in a fully upstream position, no pressurized air is discharged into outlet line 66, thus the pressurized air in line 65 unilaterally urges the piston 79, and hence the driving belt assembly 71 into full driving engagement with the mill roll 24.

The mill roller brake assembly 21 comprises two spaced-apart disk brake rotors 82 having a pneumatically actuated non-rotatable caliper assembly 83 interposed between the rotors. The rotors 82 are rotatably fixed to the mill roller 23. The caliper assembly includes at least one piston (not shown) which is responsive to pressurized air in the outlet line 66*b* for applying a braking pressure to at least two disk brake pads (not shown). The disk brake pads progressively frictionally engage and thus brake the rotors 82 and the mill roller 23 in response to an increasing amount of pressurized air in the outlet line 66*b*. The force of the drive belt 76 acting on the mill roll 24 is thus governed by the force applied by the brake assembly 21 to the mill roller 23. The result is that the two forces will equalize to provide the proper feed rate of the web to the printing stations 13.

When the feed rate of the web 12 is greater than the take-up rate, the carriage 26 is urged in a downstream direction. In response to the downstream movement of the carriage 26, the control arm 34 is progressively urged into engagement with the plunger 64 to release pressurized air into the outlet line 66. The pressurized air actuates the caliper assembly 83 to urge the brake pads into braking engagement with the rotors 82 while the drive assembly 17 simultaneously backs off engagement of the drive belt assembly 71 to permit the mill roll 24 to feed the web 12 at a slower feed rate.

Conversely, when the feed rate of the web 12 is less than the take-up rate, the carriage 26 is urged in an upstream direction which causes the control arm 34 to progressively disengage from the plunger 64 and reduce the amount of pressurized air in the outlet line 66. When the carriage is in a fully upstream position, there is no pressurized air in the outlet line 66 and caliper assembly 83 fully releases the brake pads from braking engagement with the rotors 82, which corresponds with the drive belt assembly 71 fully engaging with the mill roll 24 to increase the feed rate.

Thus, it should be apparent that the apparatus disclosed herein maintains a substantially constant tension on a web of printing medium passing through a printing press to improve the quality of a resulting composite printed image by minimizing variations in registration of the web through a plurality of stations of the press. In particular, a biasing actuator is provided which increases the effective volume of the cylinder so that a substantially constant biasing force is applied by the actuator to maintain the substantially constant tension on the web.

Also, it should be noted that the apparatus disclosed herein maintains a substantially constant tension on a web of printing medium passing through a printing press independent of an operating speed or feed rate of the printing press. Thus, accurate image registration can be maintained while the printing press operating speed or feed rate is increased or accelerated from a stopped or low feed rate condition to a greater operating speed or feed rate. Likewise, printing registration can be maintained during a decrease or deceleration of the printing press operating speed or feed rate.

While the forms of the device herein described constitute the preferred embodiments of the invention, it is to be understood that the invention is not limited to these precise forms of device, and that changes may be make therein without departing from the scope of the invention which is defined in the appended claims.

For instance, the pneumatic actuators herein described could be replaced with hydraulic actuators.

Also, the reservoir 32 could be an extended length of PVC pipe or the like which effectively increases the volume of the actuator cylinder. Further, the reservoir 32 could be an expandable rubber bladder or balloon which maintains a substantially constant pressure level by increasing the volume thereof to compensate for an increase in air pressure within the balloon.

What is claimed is:

1. An apparatus for use with a printing press comprising:

a tension regulator for maintaining a substantially constant tension level on a web of printing medium passing through the printing press, wherein the printing press includes at least one dancer roller, said tension regulator further including an actuator associated with said at least one dancer roller for maintaining a substantially constant biasing force on said at least one dancer roller, including means for controlling a feed rate of said web of printing medium in response to a position of said at least one dancer roller, and a roll of web to be fed, and said means for controlling a feed rate of said web includes a drive assembly movable into and out of engagement with said roll of web.

2. An apparatus for use with a printing press comprising a tension regulator for maintaining a substantially linear tension force on a web of printing medium in response to changes in the rate at which the web passes through the printing press;

wherein the printing press includes at least one dancer roller, and said tension regulator includes an actuator associated with said at least one dancer roller for maintaining a substantially constant biasing force on said at least one dancer roller;

wherein said actuator includes a hollow cylinder body and a piston slidably retained within said cylinder body, said piston having a first side coupled to said at least one dancer roller and a second side cooperating with said cylinder body to define a chamber having a variable volume, said piston being positionable within said cylinder body as a function of a web tension level applied to said at least one dancer roller;

wherein said tension regulator further includes a reservoir which communicates with said actuator;

wherein said reservoir is an expandable bladder.

3. An apparatus for use with a printing press comprising a tension regulator for maintaining a substantially linear tension force on a web of printing medium in response to changes in the rate at which the web passes through the printing press;

wherein the printing press includes at least one dancer roller, and said tension regulator includes an actuator associated with said at least one dancer roller for maintaining a substantially constant biasing force on said at least one dancer roller;

wherein said actuator includes a hollow cylinder body and a piston slidably retained within said cylinder body, said piston having a first side coupled to said at least one dancer roller and a second side cooperating with said cylinder body to define a chamber having a variable volume, said piston being positionable within said cylinder body as a function of a web tension level applied to said at least one dancer roller;

wherein said tension regulator further includes a reservoir which communicates with said actuator;

wherein said reservoir communicates with said chamber to define a second chamber larger than said first-mentioned chamber.

4. The apparatus claimed in claim 3, wherein said second chamber is substantially maintained at a predetermined pressure level when said piston is positioned by said at least one dancer roller.

5. The apparatus claimed in claim 4, wherein said predetermined pressure level is about 1.0 to 2.0 pounds per square inch.

6. The apparatus claimed in claim 5, wherein said predetermined pressure level is about 1.5 pounds per square inch.

7. A printing press comprising:

a plurality of successive printing stations;

a print material feeding station positioned upstream of said printing stations for supplying a web of printing material to said printing stations;

a printing material take-up station positioned downstream of said printing station for pulling said web of printing material through said printing stations and storing said printing material; and a tension regulator for maintaining a substantially linear tension force on said web of printing material in response to changes in the rate at which the web passes through said printing press;

wherein the printing press includes at least one dancer roller, and said tension regulator includes an actuator associated with said at least one dancer roller for maintaining a substantially constant biasing force on said at least one dancer roller;

wherein said actuator includes a hollow cylinder body and a piston slidably retained within said cylinder body, said piston having a first side coupled to said at least one dancer roller and a second side cooperating with said cylinder body to define a chamber having a variable volume, said piston being positionable within said cylinder body as a function of a web tension level applied to said at least one dancer roller;

wherein said tension regulator further includes a reservoir which communicates with said actuator;

wherein said reservoir communicates with said chamber to define a second chamber larger than said first-mentioned chamber.

8. The printing press claimed in claim 7, wherein said second chamber is maintained at a predetermined pressure level when said piston is positioned by said at least one dancer roller.

9. The printing press claimed in claim 8, wherein said predetermined pressure level is about 1.0 to 2.0 pounds per square inch.

10. The printing press claimed in claim 9, wherein said predetermined pressure level is about 1.5 pounds per square inch.

11. A printing press comprising:

a plurality of successive printing stations;

a print material feeding station positioned upstream of said printing stations for supplying a web of printing material to said printing stations;

a printing material take-up station positioned downstream of said printing stations for pulling said web of printing material through said printing stations and storing said printing material;

a tension regulator for maintaining a substantially constant tension level on said web of printing material passing through said printing press, and further including a dancer roller carriage for rotatably supporting said at least one dancer roller, said dancer roller carriage being positioned upstream from said printing stations and being slidable along a longitudinal axis of said printing press in a direction toward and away from said printing stations between a maximum upstream position and a maximum downstream position.

12. The printing press claimed in claim 11, wherein said tension regulator includes a linear air regulator responsive to a position of said dancer roller carriage along said longitudinal axis, said air regulator supplying a quantity of pressurized air based upon a position of said dancer roller carriage along said longitudinal axis.

13. The printing press claimed in claim 12, wherein said tension regulator further includes a progressively engageable mill roller drive assembly responsive to the pressurized air from said linear air regulator for driving a mill roller which rotatably supports said web of printing material.

14. The printing press claimed in claim 13, wherein said tension regulator further includes a progressively engageable brake associated with said mill roller drive assembly and responsive to the pressurized air from said linear air regulator for braking said mill roller.

15. The printing press claimed in claim 14, wherein said brake is fully engaged with said mill roller when said dancer roller carriage is positioned in said fully downstream position, and said brake is fully disengaged from said mill roller when said dancer roller carriage is positioned in said fully upstream position.

16. The printing press claimed in claim 13, wherein said mill roller drive assembly includes a belt and an air cylinder which drives said belt into contact with said web of printing material in response to the pressurized air.

17. The printing press claimed in claim 13, wherein said mill roller drive assembly is fully engaged with said web of print material when said dancer roller carriage is positioned in said fully upstream position, and said mill roller drive assembly is fully disengaged from said web of print material when said dancer roller carriage is positioned in said fully downstream position.

18. The printing press claimed in claim 12, wherein a plunger of said linear air regulator is progressively depressed by a free end of a cantilevered arm, said free end of said cantilevered arm being moveable toward and away from said linear air regulator by said dancer roller carriage traveling along said longitudinal axis.

19. A method for maintaining a substantially constant tension on a web of printing material being fed through a printing press to maintain a high degree of printing registry at each of a plurality of printing stations of the printing press, comprising the steps of:

passing the web of printing material through the printing press along a longitudinal axis of the printing press;

adjusting a path of travel of the web through at least one slidable dancer roller to compensate for web tension fluctuations as the web is passed through the printing press;

maintaining a constant force on the at least one slidable dancer roller as the path of travel of the web is adjusted;

varying a quantity of pressurized medium supplied to a mill roller drive assembly as a function of a position of the at least one dancer roller along said longitudinal axis; and varying a quantity of pressurized medium supplied to a mill roller brake assembly as a function of said position of the at least one dancer roller along said longitudinal axis.

* * * * *